United States Patent [19]

Fish

[11] 4,321,774

[45] Mar. 30, 1982

[54] FLOOD BARRIER

[75] Inventor: Daniel C. E. Fish, Wimbourne, England

[73] Assignee: Leigh Flexible Structures Limited, Walsall, England

[21] Appl. No.: 151,634

[22] Filed: May 20, 1980

[51] Int. Cl.[3] ..... E02B 7/00

[52] U.S. Cl. ..... 52/63; 52/169.14; 52/243; 405/115

[58] Field of Search ..... 52/63, 243, 238, 169.5, 52/169.14; 405/90, 91, 115; 49/34; 160/84 R, 33

[56] References Cited

U.S. PATENT DOCUMENTS

| | | | |
|---|---|---|---|
| 1,212,633 | 1/1917 | Hanna | 405/91 |
| 1,822,729 | 9/1931 | Fairhurst | 160/33 |
| 1,822,767 | 9/1931 | Duncanson | 160/33 |
| 1,924,963 | 8/1933 | Sherrill | 52/63 |
| 2,052,723 | 9/1936 | Richards | 52/63 |
| 3,118,363 | 1/1964 | Burgess | 405/132 |
| 3,182,459 | 5/1965 | Grether | 405/115 |
| 4,136,995 | 1/1979 | Fish | 405/115 |

FOREIGN PATENT DOCUMENTS

| | | | |
|---|---|---|---|
| 663843 | 7/1938 | Fed. Rep. of Germany | 405/91 |
| 1262851 | 2/1972 | United Kingdom | 405/115 |
| 1554159 | 10/1979 | United Kingdom | 160/84 R |

*Primary Examiner*—John E. Murtagh

*Attorney, Agent, or Firm*—Cushman, Darby & Cushman

[57] ABSTRACT

A flood barrier comprises a flexible membrane 5 the end and base parts terminating in a beading 7 of polypropylene rope. The side parts of the barrier are located in vertical channel 3 in the side walls and the base in a horizontally extending channel 4 in the floor. In normal conditions the barrier is stowed in the recesses and erected in the event of a flood warning.

2 Claims, 3 Drawing Figures

FLOOD BARRIER

The present invention relates to a barrier assembly for restraining the ingress of water to an enclosed space defined by a floor and side walls. For example a barrier in accordance with the invention would be used to prevent the flooding of an underground car park.

A barrier assembly in accordance with the present invention comprises a flexible barrier dimensioned to extend between opposed side walls of the space, means for anchoring the end walls of the barrier to the side walls, means for anchoring the base of the barrier to the floor and rigid uprights locatable in the floor and engageable with the barrier to support the latter in an upright position. There is sufficient material in the barrier to allow it to form generally semi-circular bulges between the uprights. There is thus sufficient fullness to allow the assembly, when the uprights have been removed from the floor, to be stowed in an out-of-the way position.

In an embodiment of the invention each end of the flexible barrier is secured in a vertically extending recess in the respective side wall and the base of the barrier in a channel in the floor linking the recesses. Each upright locates in a socket in the floor and when the barrier is not required the uprights are removed from the sockets and laid in the channel together with the barrier. Cover plates can then mask the channel and the recess. The barrier material should be pleated and joined to a shorter piece of material containing a rope, which rope is clamped into the wall of the recess. The extra material allowing the semi-circular bulges to form also gives sufficient slack in the material to allow it to be stowed in the recess in the walls and floor without unfastening it from the attachments in the recesses in the walls. Where the opening to be closed is narrow and deep, semi-circular bulges might not provide sufficient excess material and the material would have to be tailored to allow even larger bulges between the uprights.

The invention will now be described by way of example and with reference to the accompanying informal drawing, wherein.

Figure 1:
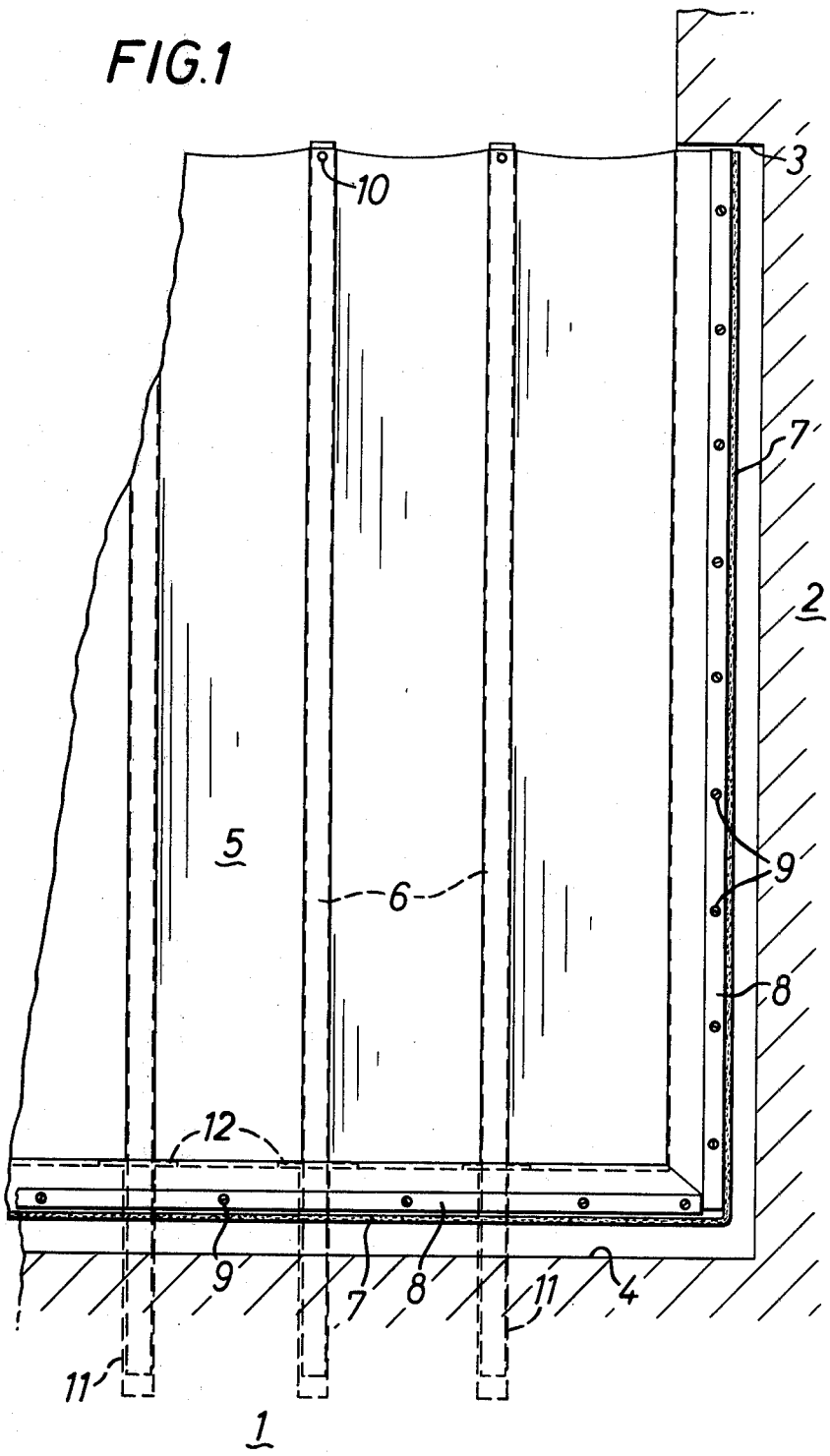
FIG. 1 is an end view of the barrier.
Figure 2:
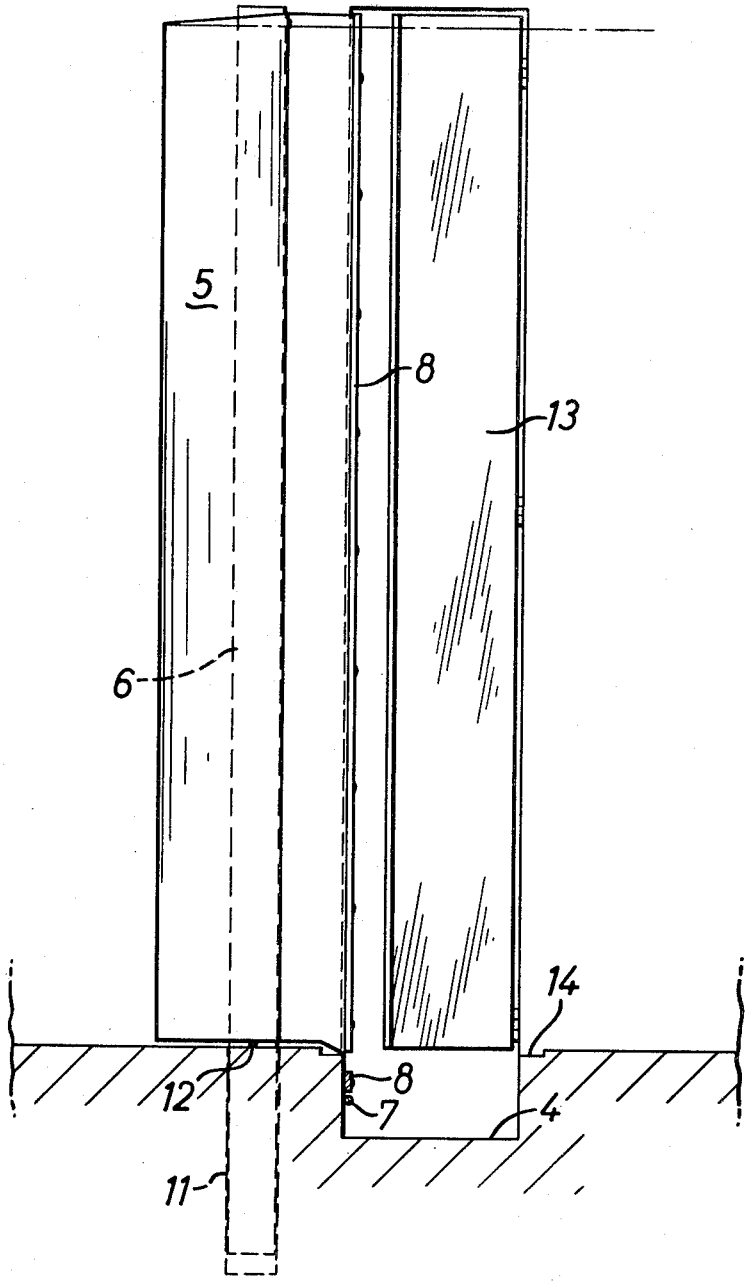
FIG. 2 is a side view.
Figure 3:
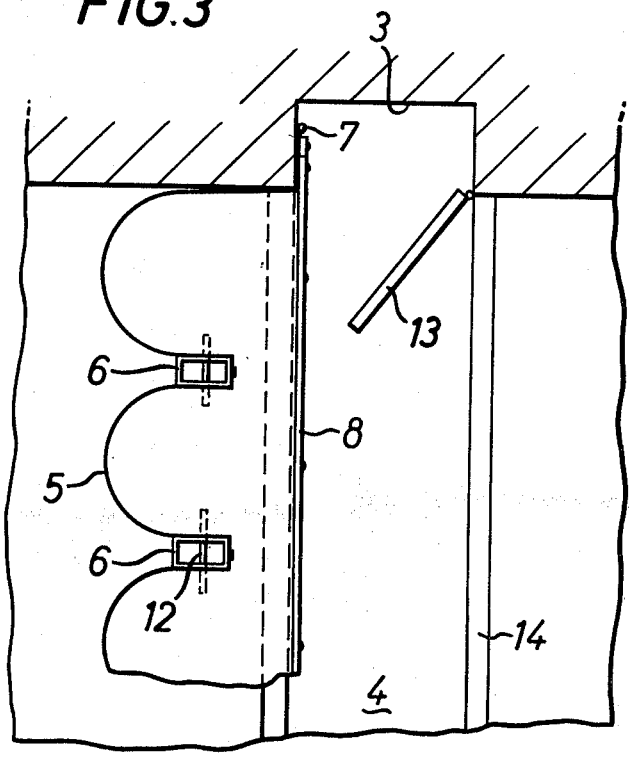
FIG. 3 is a plan.

Referring initially to FIG. 1 the structure illustrated therein comprises a floor 1 and side walls 2. Vertical channels 3 are provided in the side walls and a horizontally extending channel 4 locates the lower end parts of the vertical channels 3.

The barrier assembly comprises a flexible membrane 5, of for example woven nylon coated with neoprene, and uprights 6 of rectangular box section steel. The end parts and base of the barrier membrane 5 terminate in a beading 7 of propylene rope, and clamping bars 8 immediately inboard of the beading secure the membrane and are fixed by studs 9 to the supporting structure. The upper end parts of the uprights 6 are fixed by rivets 10 to the membrane 5 whilst the lower end parts are located in sockets 11 in the floor. Stops 12 are provided on each upright to locate the uprights at the appropriate depth.

The assembly is illustrated in the functional barrier position and it will be noted that the membrane has sufficient fullness to provide pleats which is desirable to provide effective damming. The fullness provides semi-circular bulges between the uprights. These bulges are desirable, both to reduce the stress on the fabric to a minimum and to allow sufficient surplus material so that the assembly may be stowed away in the recess in the floor without detaching it from its fixing within the side recesses. Specifically when it is desired to stow the barrier, the uprights 6 are lifted from the sockets 11 and laid in the horizontal channel 4; as mentioned above there is sufficient fullness to allow the barrier completely to be stowed when the uprights lie in the trench. A hinged door 13 (see FIG. 1) covers the recess 3 in the wall while a cover plate (not shown) locates in a recess 14 in the floor to cover the uprights and the major part of the membrane.

I claim:

1. A barrier assembly comprising a flexible flood barrier dimensioned to extend between opposed side walls of an enclosed space, when positioned between a floor and side walls each end of the barrier being secured in a vertically extending recess in the respective side wall forming a seal therebetween, and the base of the barrier being secured in a channel in the floor linking the recesses and forming a seal between the floor and barrier; and rigid uprights locatable in pre-formed floor sockets and engageable with the barrier to support the latter in an upright position, sufficient material being provided in the barrier to allow it to form generally semi-circular bulges between the uprights and to allow the assembly, when the uprights have been removed from the floor sockets, to be stowed in the vertical recesses and the channel with the ends of the barrier remaining secured in the vertical recesses and the base of the barrier remaining secured in the floor channel.

2. A barrier assembly as claimed in claim 1 wherein the barrier is formed of a pleated piece joined to shorter pieces each containing a rope, the ropes serving for clamping purposes.

* * * * *